US012797927B2

(12) United States Patent
Fischer et al.

(10) Patent No.: US 12,797,927 B2
(45) Date of Patent: Nov. 17, 2026

(54) METHOD AND DEVICE FOR PROVIDING INSERTS FOR SUPPORT AND/OR WORK ROLLS OF A ROLL STAND

(71) Applicant: SMS group GmbH, Mönchengladbach (DE)

(72) Inventors: Stephan Fischer, Hilchenbach (DE); Tom Hecker, Hilchenbach (DE); Markus Wagener, Netphen (DE)

(73) Assignee: SMS group GmbH, Mönchengladbach (DE)

( * ) Notice: Subject to any disclaimer, the term of this patent is extended or adjusted under 35 U.S.C. 154(b) by 224 days.

(21) Appl. No.: 18/861,637

(22) PCT Filed: May 12, 2023

(86) PCT No.: PCT/EP2023/062773
§ 371 (c)(1),
(2) Date: Oct. 30, 2024

(87) PCT Pub. No.: WO2023/222546
PCT Pub. Date: Nov. 23, 2023

(65) Prior Publication Data

US 2025/0289044 A1 Sep. 18, 2025

(30) Foreign Application Priority Data

May 19, 2022 (DE) ..... 10 2022 205 022.3
Oct. 13, 2022 (DE) ..... 10 2022 210 808.6

(51) Int. Cl.
*B21B 31/30* (2006.01)

(52) U.S. Cl.
CPC ..... *B21B 31/30* (2013.01); *B21B 2203/36* (2013.01)

(58) Field of Classification Search
CPC ..... B21B 31/30; B21B 31/22; B21B 2203/36; B21B 2203/32; B21B 31/08; B21B 31/10; B21B 31/106; B21B 31/028; B65D 2519/00805; B65D 2519/00796; B66C 1/10; F16B 2/065; Y10T 29/53974
See application file for complete search history.

(56) References Cited

U.S. PATENT DOCUMENTS 3,171,304 A 3/1965 Sims et al.
3,782,161 A 1/1974 McGeeney et al.

FOREIGN PATENT DOCUMENTS

DE 1800438 A1 5/1970
DE 2520666 A1 * 11/1976
DE 202022100413 U1 3/2022
(Continued)

*Primary Examiner* — Jason L Vaughan
*Assistant Examiner* — Amanda Kreiling
(74) *Attorney, Agent, or Firm* — Smartpat PLC

(57) ABSTRACT

A method relates to providing shims for backup and/or work rolls of a rolling mill stand. The shims are required when changing over rolls. The method comprises the steps of: a) assembling at least one shim, preferably at least two or three shims, into an shim pack at a first location remote from the rolling mill stand; b) transferring the shim pack into a carrier element at the first location; c) transporting the carrier element together with the shim pack from the first location to the location near the rolling mill stand; d) removing the shim pack from the carrier element at the location near the rolling mill stand; e) using the shims when changing over rolls.

12 Claims, 8 Drawing Sheets

(56) References Cited

FOREIGN PATENT DOCUMENTS

| | | | | | |
|---|---|---|---|---|---|
| GB | 2574858 | A | * | 12/2019 | ..... B65D 19/10 |
| JP | S5732703 | A | | 2/1982 | |
| JP | S57170807 | A | | 10/1982 | |
| JP | H07284825 | A | | 10/1995 | |

* cited by examiner

METHOD AND DEVICE FOR PROVIDING INSERTS FOR SUPPORT AND/OR WORK ROLLS OF A ROLL STAND

CROSS-REFERENCE TO RELATED APPLICATION

This application is a national stage application, filed under 35 U.S.C. § 371, of International Patent Application PCT/EP2023/062773, filed on May 12, 2023, which claims the benefit of German Patent Applications DE 10 2022 205 022.3, filed on May 19, 2022, and DE 10 2022 210 808.6, filed on Oct. 13, 2022.

TECHNICAL FIELD

The disclosure relates to a method for providing shims for backup and/or work rolls of a rolling mill stand, which shims are required when changing over rolls. The disclosure also relates to a device for this purpose.

BACKGROUND

In particular when changing over the backup rolls of a rolling mill stand, shims are required, which are placed in a so-called changeover carriage. The shims are used to compensate for roll wear on the lower rolls, such that the level of the upper edge of the lower work rolls is subject to as little fluctuation as possible. The shims are replaced in the changeover carriage. It is usual that the respective shims are transported individually from a preparation workshop to the backup roll changeover pit by means of an overhead crane. Each individual shim is inserted and centered separately in the backup roll changeover carriage. When removing, the corresponding steps are carried out in reverse order.

In U.S. Pat. No. 3,782,161 A the generic method that is used when changing over rolls of a rolling mill stand is described. A number of plates are provided there, which are arranged independently of one another and are used for the individual parts to be changed.

Therefore, the disadvantage of this is that the changeover of backup rolls takes a correspondingly long time: It is necessary to remove the individual shim plates and install the new shim plates, which requires corresponding crane movements; only then can the insertion of new backup rolls be effected.

Up to 30 crane movements may be necessary in order to transport the individual shims to the roll changeover pit (including empty runs of the crane). Each shim is driven and fastened individually. Furthermore, each shim must be centered in the changeover carriage. During assembly/disassembly, the fastening of each shim is effected by means of two eyebolts.

Another problem is that the individual shim plates adhere strongly to one another, since oil between the plates causes high adhesion forces and makes it difficult to disassemble the individual plates. There is a risk of accidents to the extent that plates hanging from the crane and sticking together can come loose during transport and fall down.

SUMMARY

The disclosure is based on the object of simplifying the logistics upon changing over the rolls of a rolling mill stand, in particular the backup rolls, and reducing the changeover times. As a result, the efficiency of the rolling process is to be improved. Thus, the changeover times for shims are to be significantly reduced, which will also lead to a corresponding reduction in changeover times for backup rolls. Ultimately, the aim is to improve employee safety.

The solution to this object provides a method for the provision of shims for backup and/or work rolls of a rolling mill stand, which are required when changing over rolls. The method comprises the steps of:

a) assembling of at least one shim, preferably at least three shims, into a shim pack at a first location that is remote from the rolling mill stand;
b) inserting the shim pack into a carrier element at the first location;
c) transporting the carrier element together with the shim pack from the first location to the location near the rolling mill stand;
d) removing the shim pack from the carrier element at the location near the rolling mill stand;
e) using of the shims when changing over rolls.

The above-mentioned step d) can comprise the following step: Intermediately storing the shim pack in an intermediate storage element.

Prior to step e) above, the shim pack can be placed in a roll changeover carriage.

The specified first location is, in particular, a preparation workshop (located some distance from the rolling mill stand whose rolls are to be changed).

The location near the rolling mill stand is preferably a roll changeover pit or a location directly adjacent to it.

The method is used in particular for changing over the backup rolls of the rolling mill stand.

A device for providing and/or transporting shims for backup and/or work rolls of a rolling mill stand, which are required when changing over rolls, comprises a carrier frame, which has means for coupling to a crane, and connecting means for positively connecting shims combined to form a shim pack to the carrier frame.

The connecting means are designed in particular as screws/comprise screws. Particularly preferably, two screws are arranged on the carrier frame, in particular diagonally.

Furthermore, centering means can be arranged on the carrier frame, which centering means are designed for centering the shim pack relative to the carrier frame.

For optimum securing of the individual shims, they can have recesses, preferably two recesses each, which correspond to the position of the screws. With the screws being screwed in, the individual shims are secured in this way.

The device further preferably comprises a base plate, which is formed with threaded holes for engagement of the screws, wherein the base plate is designed to carry the shim pack.

As explained above, another problem is that the shim pack adheres to the base on which it rests due to adhesion (as a result of an oil film). In order to be able to solve this problem, a further development provides that the length of the thread of the screws is greater than the length of the threaded hole in the base plate, preferably greater by 1 mm to 5 mm. Then, by tightening the screws, it can be achieved that the shim pack is pressed away from the substrate, thereby overcoming adhesion.

As explained, the proposed method/the described device is used in particular for changing over the shim packs in the backup roll changeover carriage of rolling systems.

The method/device allows the changeover times of the shims in the (backup roll) changeover carriage to be shortened, thus generally reducing the changeover times of the (backup) rolls.

The shims are combined into shim packs of at least one, preferably at least two or three, and in particular a maximum of five shims. The packet is then transported as one part (by overhead crane). As a result, the need for crane trips is significantly eliminated; the "delivery time" of the shims (to the changeover carriage/changeover pit) is considerably reduced. The specified centering means are provided for the precise centering of the shim pack. A reliable and secure connection between the carrier element and the shim pack can be achieved with just two screws, which offers corresponding advantages in terms of handling.

The shim packs are prepared in the preparation workshop in particular.

The intermediate storage element (a "dummy carriage", so to speak) is loaded with the required shim packs. The intermediate storage element preferably has a plurality of regions, namely those for used shim packs in each case for the drive and operating side and those for newly adjusted shim packs, also in each case for the drive and operating side. The receptacles in the intermediate storage element are designed in such a way that the shim packs are held there and that the lifting tool (carrier element lifted by the overhead crane) can remove them from there. The intermediate storage element can be transported to the roll changeover pit by crane or by means of other transport equipment.

The intermediate storage element can also be transported with the newly adjusted shim packs, as close as possible to the changeover region (i.e. to the (backup) roll changeover pit), by means of a lifting tool to the rolling system.

The (backup) roll is then moved out of the rolling mill stand and removed from the roll changeover pit.

The intermediate storage element, including the prepared shim packs, is received by means of a lifting tool (crane) and moved to one side (operating side) of the (backup) roll changeover carriage.

The shim packs are preferably fixed manually using the two specified screws. However, the fixing of the shim pack to the carrier element can also be carried out by means of other conventional fixing elements (e.g., by means of an automatic locking mechanism or by means of a lever).

The (old) shim packs are then lifted from the roll changeover carriage with the carrier element and deposited on the intermediate storage element. The fixing element is released.

Now, the carrier element is moved over the new (delivered) shim packs of the respective side (drive or operating side), the shim packs are fixed as described above and are now positioned in the changeover pit in the now empty position and released from the carrier element by loosening the screws.

This operation is then repeated for the site that has not yet been processed.

Fixing/releasing in the carrier element and also fixing in the roll changeover carriage can also be carried out automatically. For this purpose, corresponding devices can be provided on the carrier element.

A gap (approximately 1 to 5 mm) can be created between the shim packs and their support surface (cover of the load cell) by tightening the screws, which makes it easier to release the shim packs (by overcoming adhesion).

This results in an easy installation of the shim packs and a significant time savings compared to the previously known procedure. At the same time, the safety of the method is also ensured.

BRIEF DESCRIPTION OF THE DRAWINGS

The drawing shows an exemplary embodiment of the invention. The following are shown.

DETAILED DESCRIPTION

Figures 1, 1A:
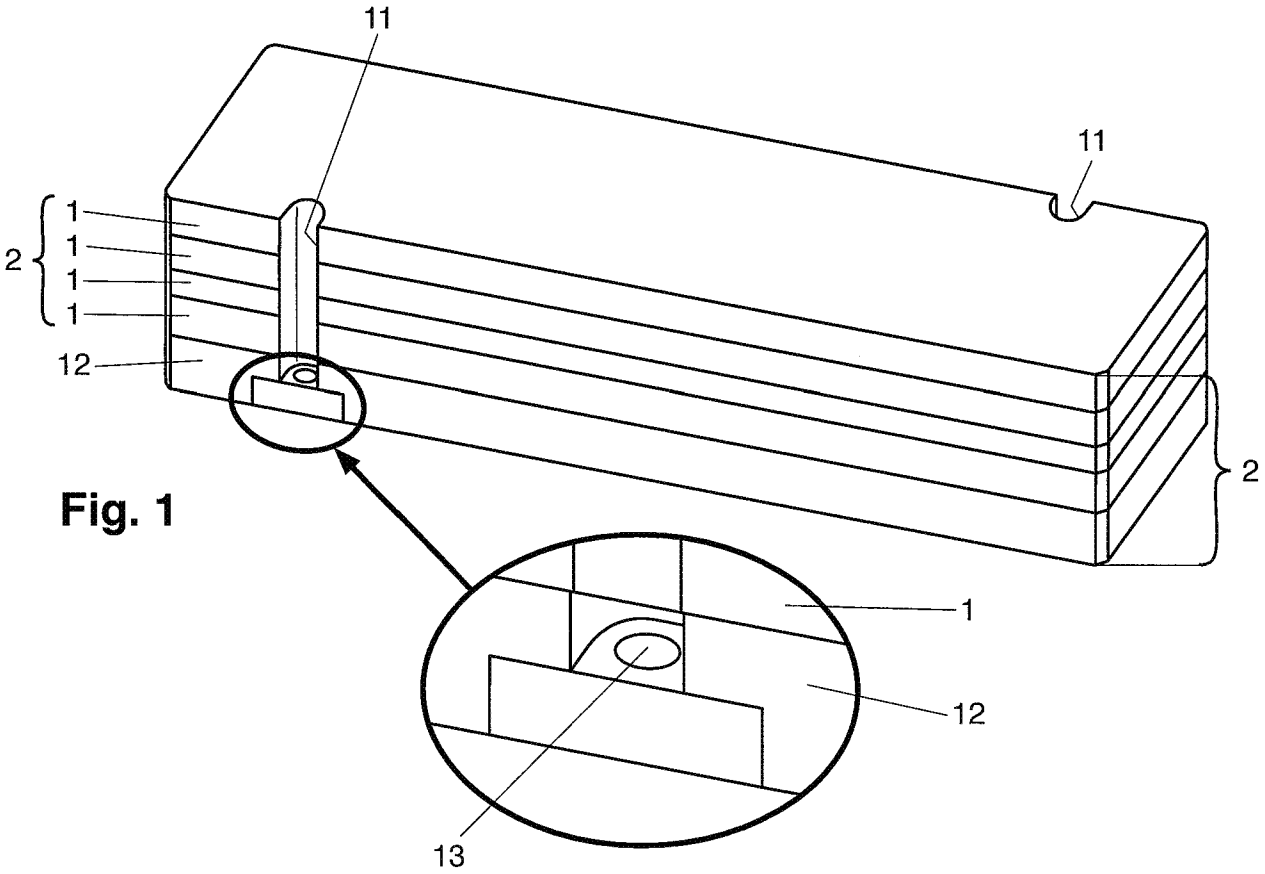
FIG. 1 shows a plurality of shims combined to form a shim pack, which shims rest on the base plate of a carrier element.
FIG. 1*a* shows the enlargement of a part of the base plate.

FIG. 1 shows four shims 1 that have been combined to form a shim pack 2. The shims 1 are required for changing over the backup rolls of a rolling mill stand. For this purpose, the shims 1 are prepared in a preparation workshop (which is located at some distance from the rolling mill stand and is not shown in the figures) and then transported (by overhead crane) to the rolling mill stand, where they are needed for the roll changeover. The shim pack 2 rests on a base plate 12, which is (so to speak, temporarily) part of a carrier element 3, which is provided for transporting the shims 1. On the other hand, the entire pack consisting of the shims 1 and the base plate 12 is mounted in the rolling mill stand, such that the base plate 12 then remains part of the pack 2.

FIG. 1*a* shows that the base plate 12 has a recess in its lower region, into which a shim part is placed, which is fitted with a threaded hole 13. Screws 8, 9 are screwed into the threaded hole 13, which screws secure the shim pack 2 to the carrier element 3. In order to achieve this reliably, the individual shims 1 have recesses 11, in which the shafts of the screws 8, 9 come to rest if they are screwed into the base plate 12. The two recesses 11 per shim 1 are provided diagonally, as shown in FIG. 1.

Figure 2:
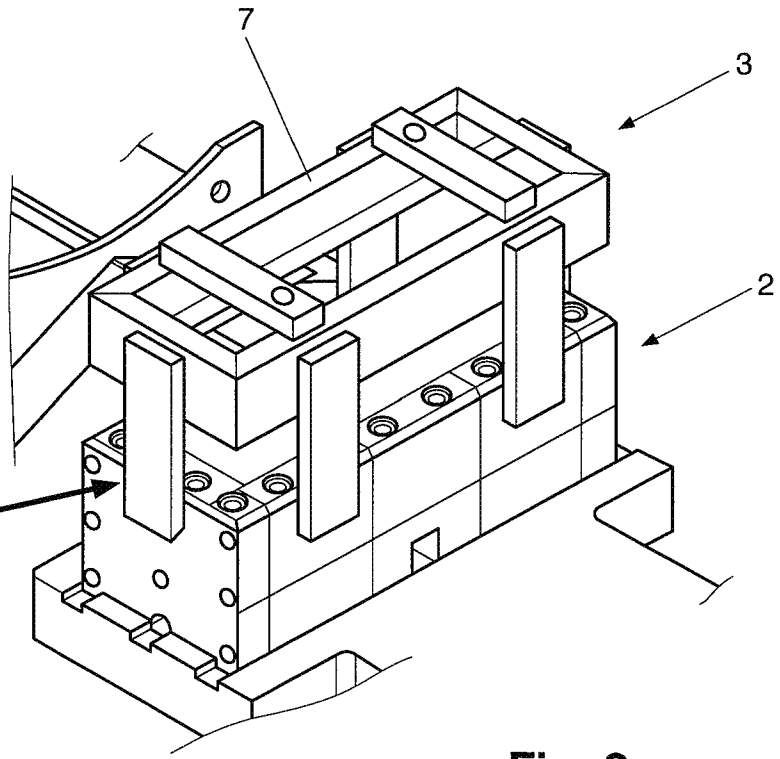
FIG. 2 shows a carrier element that is currently receiving a shim pack.

FIG. 2 shows how the carrier element 3 grasps a shim pack 2, in order to receive and transport it. The carrier element 3 consists of a carrier frame 7, which can be coupled to an overhead crane (not shown in the figures).

Figure 2A:
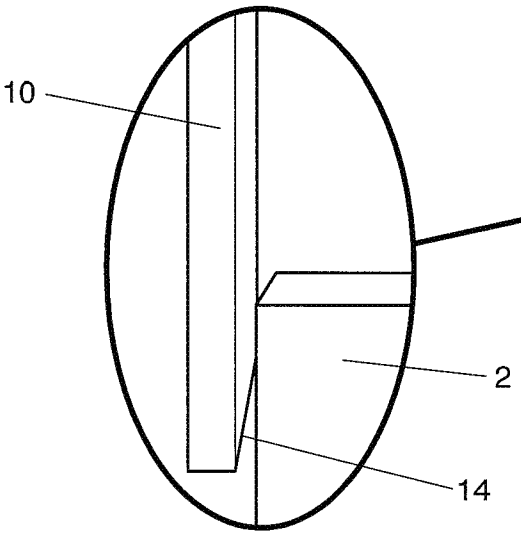
FIG. 2*a* shows the enlargement of a part of the carrier element, namely centering means, in interaction with the shim pack.

A plurality of centering means 10 (six in the exemplary embodiment) are fastened to the carrier frame 7, which are designed as rods extending in a vertical direction, which have an insertion slope 14 in the lower end region, as can be seen in FIG. 2*a*.

Figures 3, 3A:
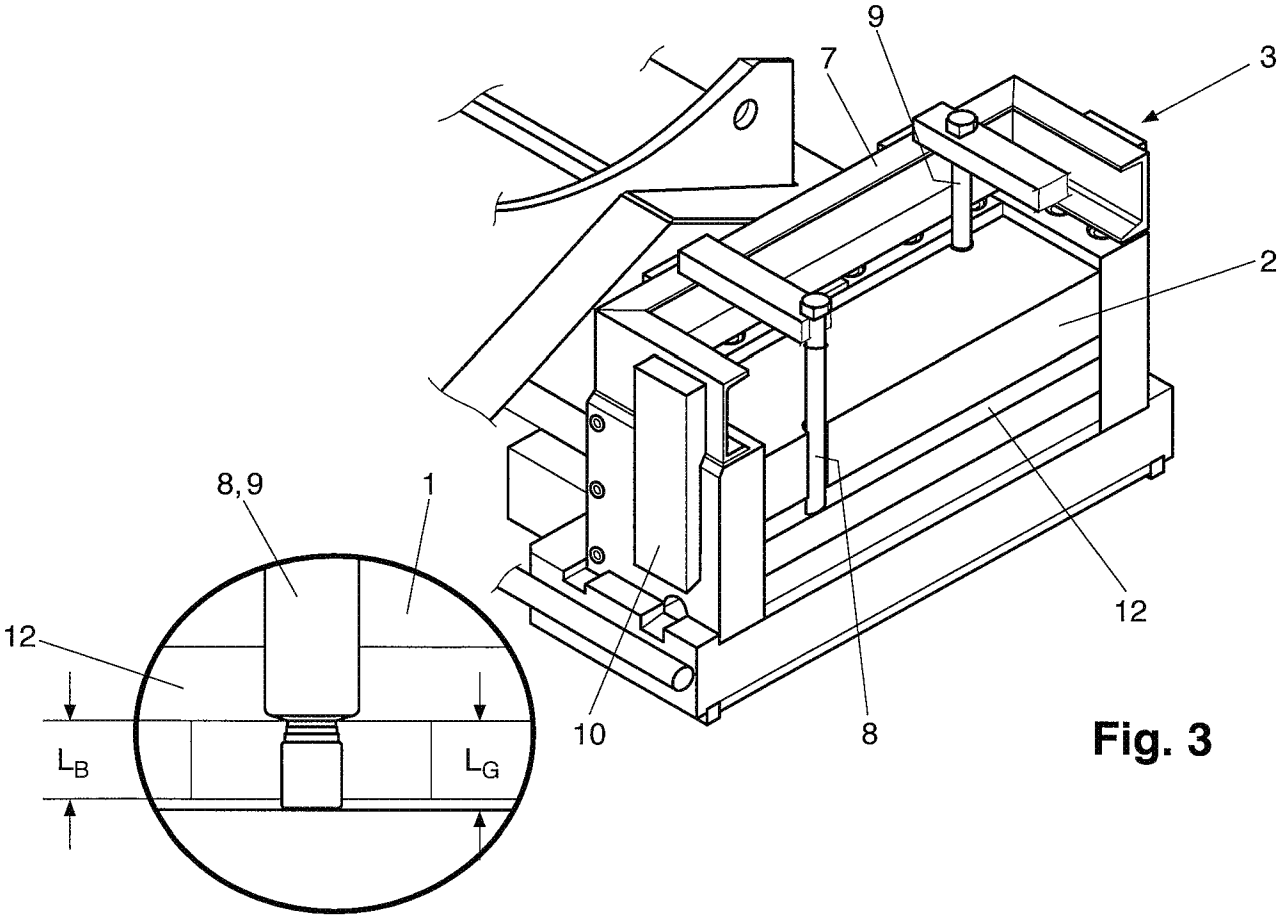
FIG. 3 shows the carrier element that has received the shim pack, wherein this is fixed to the carrier element by means of screws.
FIG. 3*a* shows the enlargement of a part of the base plate with a screwed-in screw.

FIG. 3 shows how the carrier element 3 has grasped a shim pack 2 and the latter is firmly (positively) connected to the carrier element. For this purpose, the two screws 8 and 9 are guided through corresponding through-holes in the upper region of the carrier frame 7. The screws 8, 9 are screwed into the base plate 12 and into the threaded holes 13 provided there (see FIG. 1*a*). The shim pack 2 is secured relative to the carrier element 3 by the recesses 11 (see FIG. 1).

Problems occasionally arise because the underside of the shim pack 2 and in particular the base plate 12 is held to the substrate by adhesion. In order to avoid this, the length of the thread $L_G$ of the screws 8, 9 is designed to be longer than the length of the threaded hole $L_B$, as shown in FIG. 3*a*. This makes it possible to press the underside of the base plate 12 away from the substrate by screwing in the screws 8, 9 accordingly, thus eliminating adhesion effects.

Figure 4:
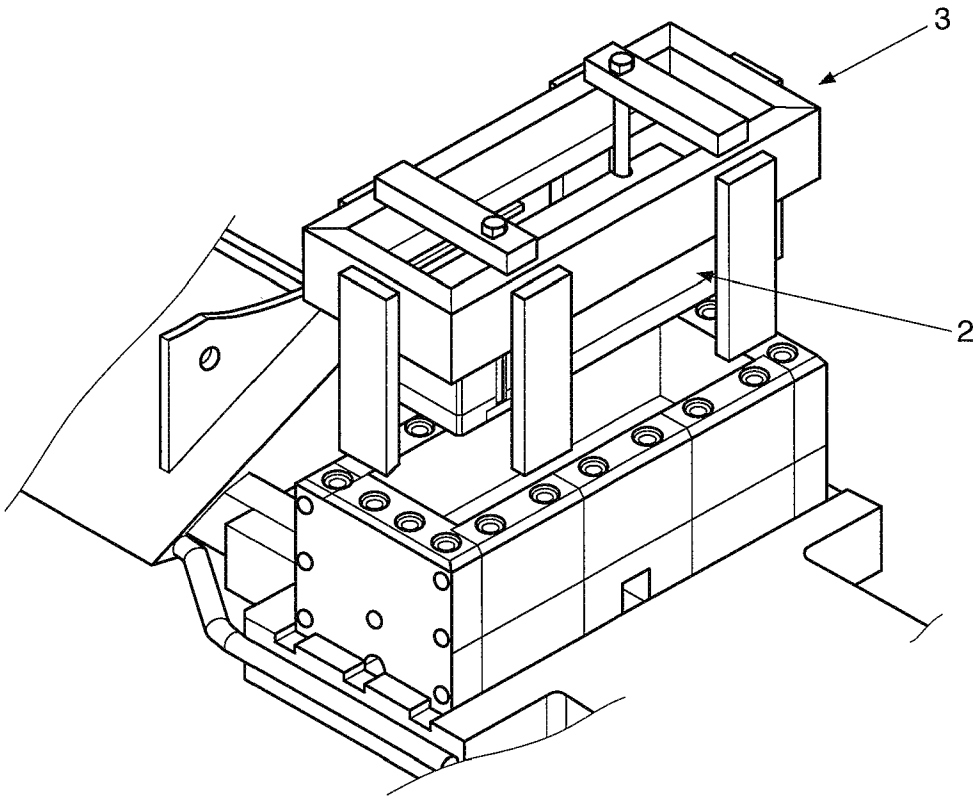
FIG. 4 shows the carrier element that receives a shim pack.
Figure 5:
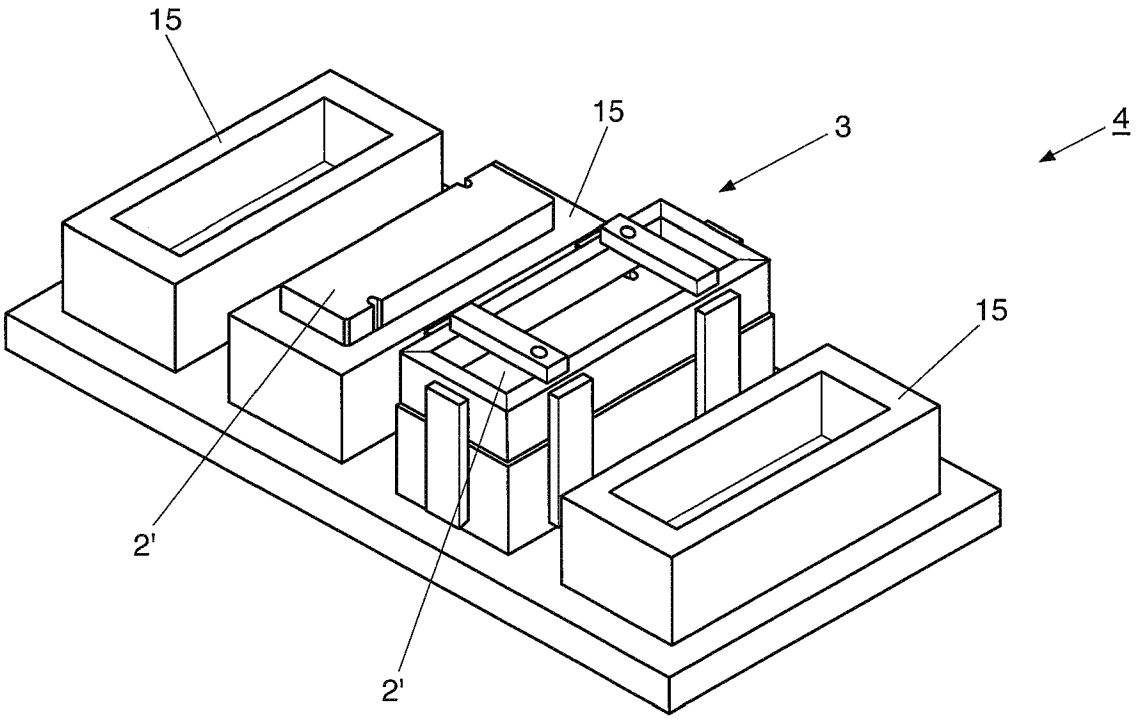
FIG. 5 shows an intermediate storage element that has a plurality of, namely four, receptacles for shim packs.

FIG. 4 shows once again how the carrier element 3 has grasped a shim pack 2 located beneath it. It is then transported (by overhead crane) to an intermediate storage element 4, which is shown in FIG. 5. In the exemplary embodiment, the intermediate storage element 4 has four receptacles 15 for the respective shim packets 2. FIG. 5 shows how two of the receptacles 15 (namely the two middle receptacles) are in each case loaded with a new shim pack 2', wherein the carrier element 3, which has just moved a shim pack 2' into the receptacle 15 of the intermediate storage element 4, is shown here again.

FIGS. 6 to 9 show various stages that illustrate the sequence of providing new shim packs 2' for the roll changeover of a backup roll of a rolling mill stand, wherein the new shim packs 2' replace the old shim packs 2". The old shim packs 2" are transported away from the rolling mill stand/the roll changeover carriage.

Figures 6, 6A:
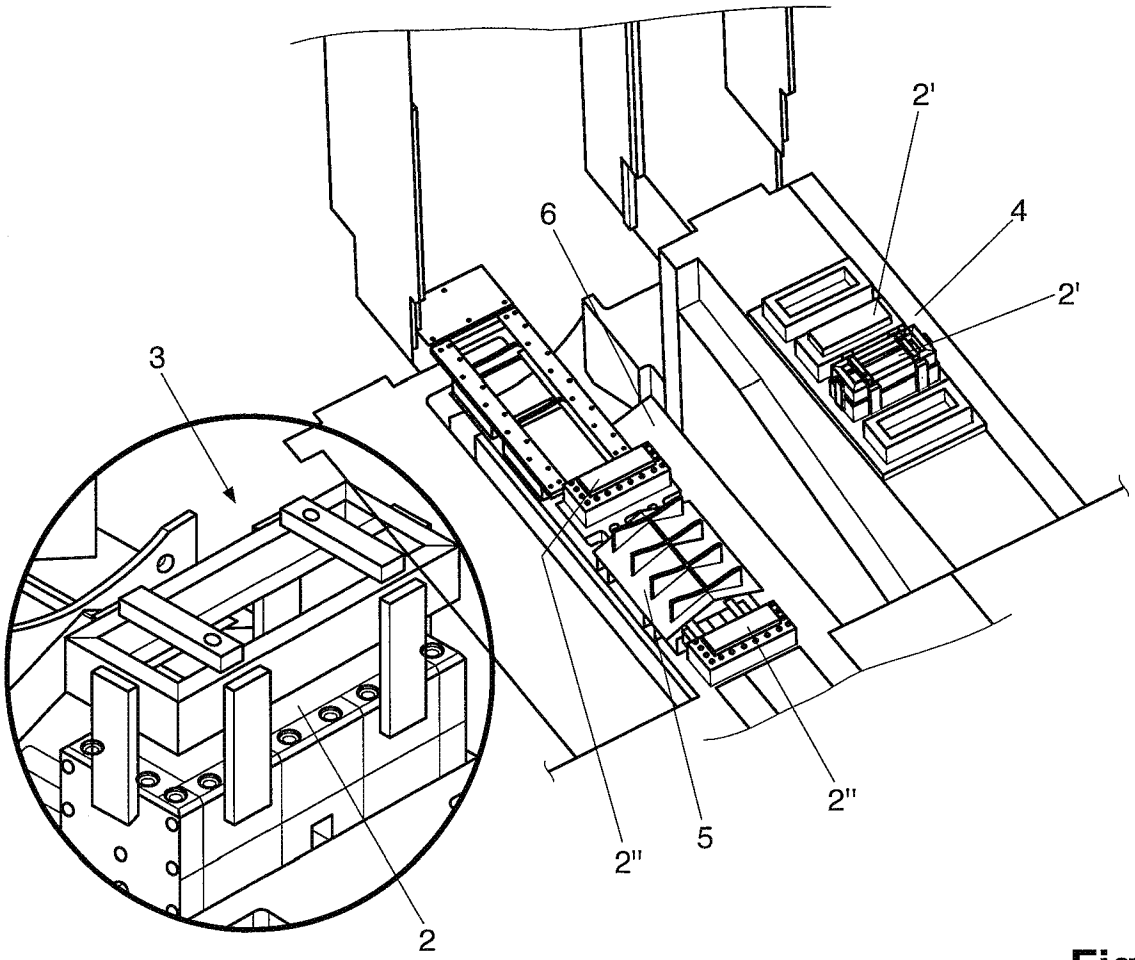
FIG. 6 shows the part of a rolling mill stand with a roll changeover carriage and a roll changeover pit, wherein the intermediate storage element is arranged next to the roll changeover pit.
FIG. 6*a* shows the receiving of a shim pack by means of the carrier element.

FIG. 6 initially shows the intermediate storage element 4 with the loading of two new shim packs 2' (as shown in FIG. 5). The intermediate storage element 4 is located directly adjacent to a roll changeover pit 6, on which a roll changeover carriage 5 is arranged. In FIG. 6, the roll changeover carriage 5 is still fitted with two used shim packs 2", which have been removed from the rolling mill stand. The gripping of a shim pack 2, either from the intermediate storage element 4 or from the roll changeover carriage 5, is illustrated once again in FIG. 6*a*.

Figure 7:
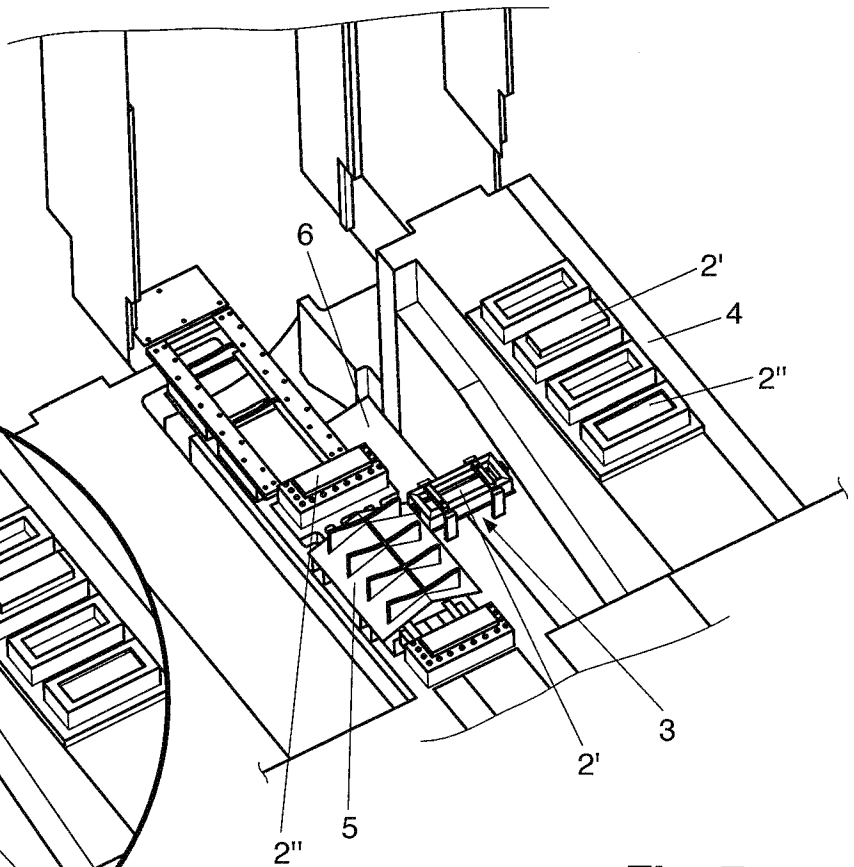
FIG. 7 shows the transport of a new shim pack from the intermediate storage element to the roll changeover carriage.

FIG. 7 shows how a new shim pack 2' is transported from the intermediate storage element 4 to the roll changeover carriage 5. The intermediate storage element 4 is still loaded with a new shim pack 2' and already loaded with a used shim pack 2".

Figure 8:
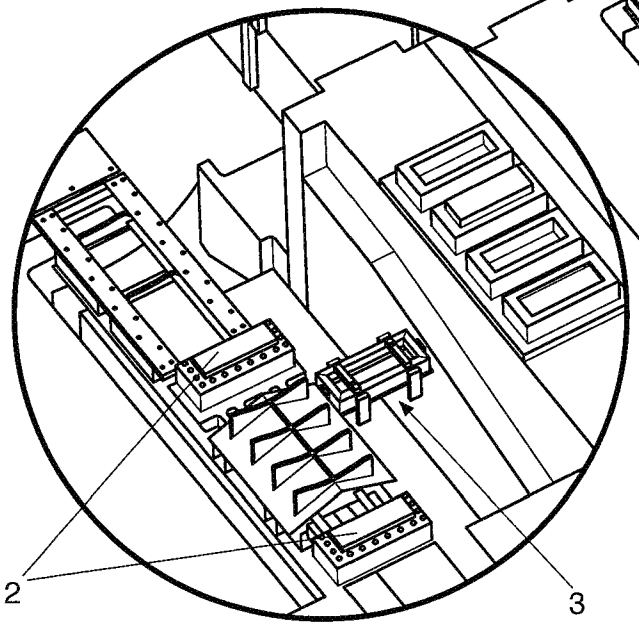
FIG. 8 shows the arrangement in accordance with FIG. 7, wherein a new shim pack is still located in the intermediate storage element and a further new shim pack is already placed in the roll changeover carriage.

FIG. 8 shows how the new shim pack 2' was moved into the roll changeover carriage 5. At this stage, the exchange of the old shim packs 2" for new shim packs 2' has taken place for half of one side of the rolling mill stand (the drive side or the operating side).

Figure 9:
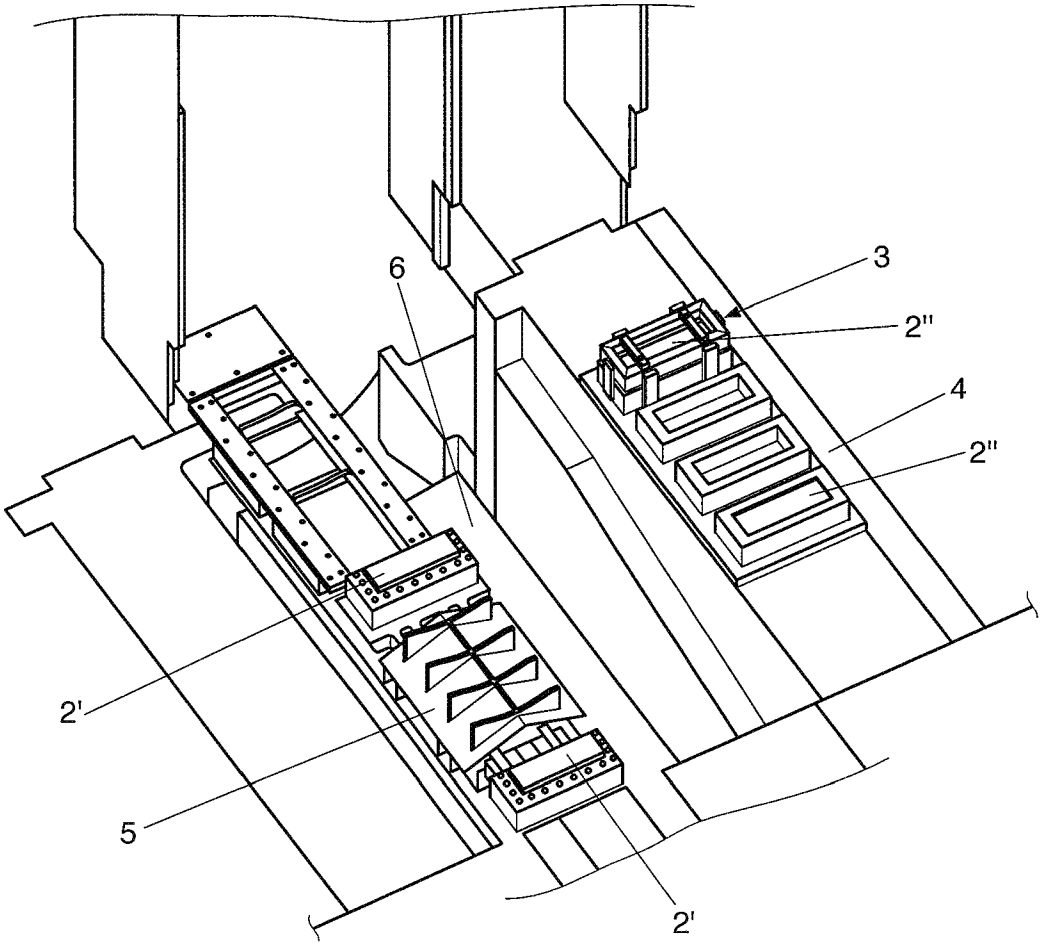
FIG. 9 shows the roll changeover carriage loaded with two new shim packs and two old shim packs arranged in the intermediate storage element.

Finally, FIG. 9 shows how the two old shim packs 2" were moved into the intermediate storage element 4, while the two new shim packs 2' are placed in the roll changeover carriage 5.

Depending on requirements, the intermediate storage element 4 can be positioned either to the side or behind the roll changeover pit 6 by overhead crane.

Through the described arrangement and procedure, the logistics for supplying the rolling mill stand/the roll changeover carriage with new shim packs can be simplified, consequently significantly reducing the number and duration of crane trips.

LIST OF REFERENCE SIGNS

1 Shim
2 Shim pack
2' New shim pack
2" Old shim pack
3 Carrier element
4 Intermediate storage element
5 Roll changeover carriage
6 Roll changeover pit
7 Carrier frame
8 Connecting means (screw)
9 Connecting means (screw)
10 Centering means
11 Recess in the shim
12 Base plate
13 Threaded hole
14 Insertion slope
15 Receptacle for a shim pack
$L_G$ Length of the thread
$L_B$ Length of the threaded hole

The invention claimed is:

1. A method for providing shims (1) for backup and/or work rolls of a rolling mill stand, the shims (1) being required when changing over rolls, wherein the method comprises:

a) assembling at least two shims (1) into a shim pack (2) at a first location remote from the rolling mill stand;

b) inserting the shim pack (2) into a carrier element (3) at the first location, wherein the carrier element (3) comprises a carrier frame (7), wherein the carrier frame (7) comprises means for coupling the carrier frame (7) with a crane, wherein the carrier frame (7) comprises screws (8, 9) for positively connecting the at least two shims (1) combined into the shim pack (2) to the carrier frame (7), wherein recesses (11) corresponding to positions of the screws (8, 9) are formed in the shims (1), wherein the at least two shims (1) are arranged on a base plate (12) for carrying the shim pack (2), wherein the base plate (12) includes threaded holes (13) for engagement of the screws (8, 9);

c) transporting the carrier element (3) together with the shim pack (2) from the first location to a second location near the rolling mill stand;

d) removing the shim pack (2) from the carrier element (3) at the second location; and e) using the shims (1) when changing over the backup and/or work rolls.

2. The method according to claim 1, wherein removing the shim pack (2) from the carrier element (3) comprises intermediately storing the shim pack (2) in an intermediate storage element (4).

3. The method according to claim 1, further comprising placing the shim pack (2) into a roll changeover carriage (5) prior to using the shims (1) when changing over rolls.

4. The method according to claim 1, wherein the first location is a preparation workshop.

5. The method according to claim 1, wherein the second location is a roll changeover pit (6) or a location directly adjacent thereto.

6. The method according to claim 1, wherein the method is carried out for changing backup rolls of the rolling mill stand.

7. A system, comprising:

shims (1) that are required when changing backup and/or work rolls of a rolling mill stand, the shims (1) being assembled into a shim pack (2); and a device for providing and/or transporting the shims (1), wherein the device comprises a carrier frame (7) including means for coupling the carrier frame (7) with a crane, screws (8, 9) for positively connecting the shims (1) combined to the shim pack (2) to the carrier frame (7), and a base plate (12) for carrying the shim pack (2), the base plate (12) having threaded holes (13) for engagement of the screws (8, 9), wherein recesses (11) corresponding to positions of the screws (8, 9) are formed in the shims (1).

8. The system according to claim 7, wherein the screws (8, 9) are two screws (8, 9) arranged diagonally on the carrier frame (7).

9. The system according to claim 7, further comprising centering means (10) arranged on the carrier frame (7), wherein the centering means are designed for centering the shim pack (2) relative to the carrier frame (7).

10. The system according to claim 7, wherein the recesses (11) include two recesses (11) formed in each of the shims (1).

11. The system according to claim 7, wherein a length ($L_G$) of a thread of the screws (8, 9) is greater than a length ($L_B$) of the threaded holes (13) in the base plate (12).

12. The system according to claim 7, wherein a length ($L_G$) of a thread of the screws (8, 9) is greater than a length ($L_B$) of the threaded holes (13) in the base plate (12) by 1 mm to 5 mm.

* * * * *